US005980240A

United States Patent [19]

Krautzig et al.

[11] Patent Number: 5,980,240

[45] Date of Patent: Nov. 9, 1999

[54] BURNER

[75] Inventors: Joachim Krautzig, Widen; Uy-Liem Nguyen, Baden-Dättwil, both of Switzerland

[73] Assignee: Asea Brown Boveri AG, Baden, Switzerland

[21] Appl. No.: 09/210,741

[22] Filed: Dec. 15, 1998

[30] Foreign Application Priority Data

Dec. 22, 1997 [EP] European Pat. Off. ..... 97 811 010

[51] Int. Cl.[6] ..... F23Q 9/00

[52] U.S. Cl. ..... 431/285; 431/350; 431/354

[58] Field of Search ..... 431/285, 354, 431/350

[56] References Cited

U.S. PATENT DOCUMENTS 4,198,815 4/1980 Bobo et al. .
5,479,773 1/1996 McCoomb et al. .
5,562,441 10/1996 Dobbeling et al. ..... 431/354

FOREIGN PATENT DOCUMENTS

0321809B1 5/1991 European Pat. Off. .
19548853A1 7/1997 Germany .
05141657 6/1993 Japan .
2287310 9/1995 United Kingdom .

*Primary Examiner*—Carroll Dority
*Attorney, Agent, or Firm*—Burns, Doane, Swecker & Mathis, L.L.P.

[57] ABSTRACT

In a burner of the double cone type, at least one relief slit (30) is arranged in the front plate (18) locally between the regions having different axial expansions. The flexible connection remaining between the two outlet regions may be made integrally within the same casting or via a further welded-on part. Excessive thermal stresses are advantageously avoided thereby.

8 Claims, 3 Drawing Sheets

BURNER

BACKGROUND OF THE INVENTION

1. Field of the Invention

The invention relates to the field of combustion technology. It is concerned with a burner of the double cone type which is known, for example, from the publication EP 0,321,809 B1.

2. Description of Background

EP 0,321,809 B1 describes the basic design of a premixing burner of the double cone type. This burner essentially consists of at least two hollow part-cone bodies supplementing one another to form a body, with tangential air inlet slits and feeds for gaseous and liquid fuels, in which burner the center axes of the hollow part-cone bodies have a taper widening in the direction of flow and run so as to be offset relative to one another in the longitudinal direction. A fuel nozzle is placed on the burner head in the conical interior formed by the part-cone bodies. The gaseous fuel is fed to the combustion air stream, before it flows into the burner interior, via gas injectors arranged along the inlet slits. The formation of the fuel/air mixture thus takes place directly at the end of the tangential air inlet slits.

The premixing burner has, on the combustion space side, a front plate which serves as an anchorage for the part-cone bodies.

Like many other components of thermal machines, the burner of the double cone type also has high thermal stresses as a result of being subjected to media at widely varying temperatures.

Thus, widely differing thermal stresses occur in this premixing burner due to the fact that the outer parts of the part-cone bodies have lower temperatures than the inner parts, since the outer parts are subjected to radiation to a less pronounced extent and are cooled to a greater extent by the inflowing air and by the cold gaseous fuel fed in the same region via ducts. This gives rise, above all, to different thermal expansions of the part-cone bodies and of the gas feed ducts connected to them, said expansions exerting a load cyclically on, above all, the front plate connecting them, this having the adverse effect of causing fatigue cracks, thus reducing the life of the burner.

This thermal stress is system-induced and, in terms of the differential thermal expansions in the direction of the burner axis, can be changed only to an inadequate extent.

SUMMARY OF THE INVENTION

The invention is intended to remedy this. The object on which it is based is to change the known burner of the double cone type by simple design means, in such a way that it is largely relieved of thermal stresses.

In a burner for the combustion of liquid and gaseous fuels, essentially consisting of at least two hollow part-cone bodies supplementing one another to form a body, with tangential air inlet slits and with feeds for gaseous and liquid fuels, in which burner the center axes of the hollow part-cone bodies have a taper widening in the direction of flow and run so as to be offset relative to one another in the longitudinal direction, a fuel nozzle for the liquid fuel being placed on the burner head in the conical interior formed by the part-cone bodies, and the feeds for the gaseous fuel being provided with fuel injectors, and a front plate being arranged, on the combustion space side, as an anchorage for the part-cone bodies, said part-cone bodies undergoing different thermal expansions in the direction of the burner axis as a result of different thermal stress, in particular the front plate being subjected cyclically to stress at the burner outlet, this is achieved, according to the invention, in that, for the purpose of an increase in flexibility, at least one relief slit is arranged in the front plate locally between the regions having different axial expansion, in such a way that the part-cone bodies are not separated completely from one another, but a material bridge still remains between them.

The advantages of the invention are that, by virtue of the flexible design of the connection of the regions having different axial expansions, excessive thermal stresses at the burner outlet are avoided and the life of the burner is therefore increased.

In this case, the at least one relief slit per part-cone body may be arranged integrally within the front plate, which consists of a single part, the necessary material bridge being formed by outer regions of the front plate itself or by means of an additional part welded to the front plate.

It is advantageous if the relief slit in the front plate commences in the region where the part-cone bodies meet and runs essentially parallel to the respective part-cone body, and the termination of the relief slit is curved in the direction of the part-cone bodies.

Furthermore, in the case of a relief slit arranged integrally within the front plate, it is expedient if the tip of the relief slit is deflected in its direction relative to the direction of the main extent of the relief slit by at least approximately 180°, deflection taking place in a curvature having generous dimensions in terms of notch and fracture mechanics, the greatest radius of curvature being located at the point of maximum stress in the front plate, and the wall piece within the arc of curvature being connected to the rest of the wall via a sufficiently dimensioned material bridge (not to be confused with the material bridge between the part-cone bodies). The slit then does not result in the undesirable growth of cracks.

Finally, it is advantageous if the curvature of the relief slit termination has the form of a semi-circle to three-quarter circle, semi-circle to three-quarter ellipse, semi-circle to three-quarter spiral or similar curve, because these forms are particularly suitable for preventing the growth of cracks.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, which illustrate several exemplary embodiments of the invention with reference to a burner of the double cone type, which is used, for example, for operating a gas turbine, and wherein.

Only the elements essential for understanding the invention are shown. The direction of flow of the various media is designated by arrows.

DESCRIPTION OF THE PREFERRED EMBODIMENTS

Figure 1:
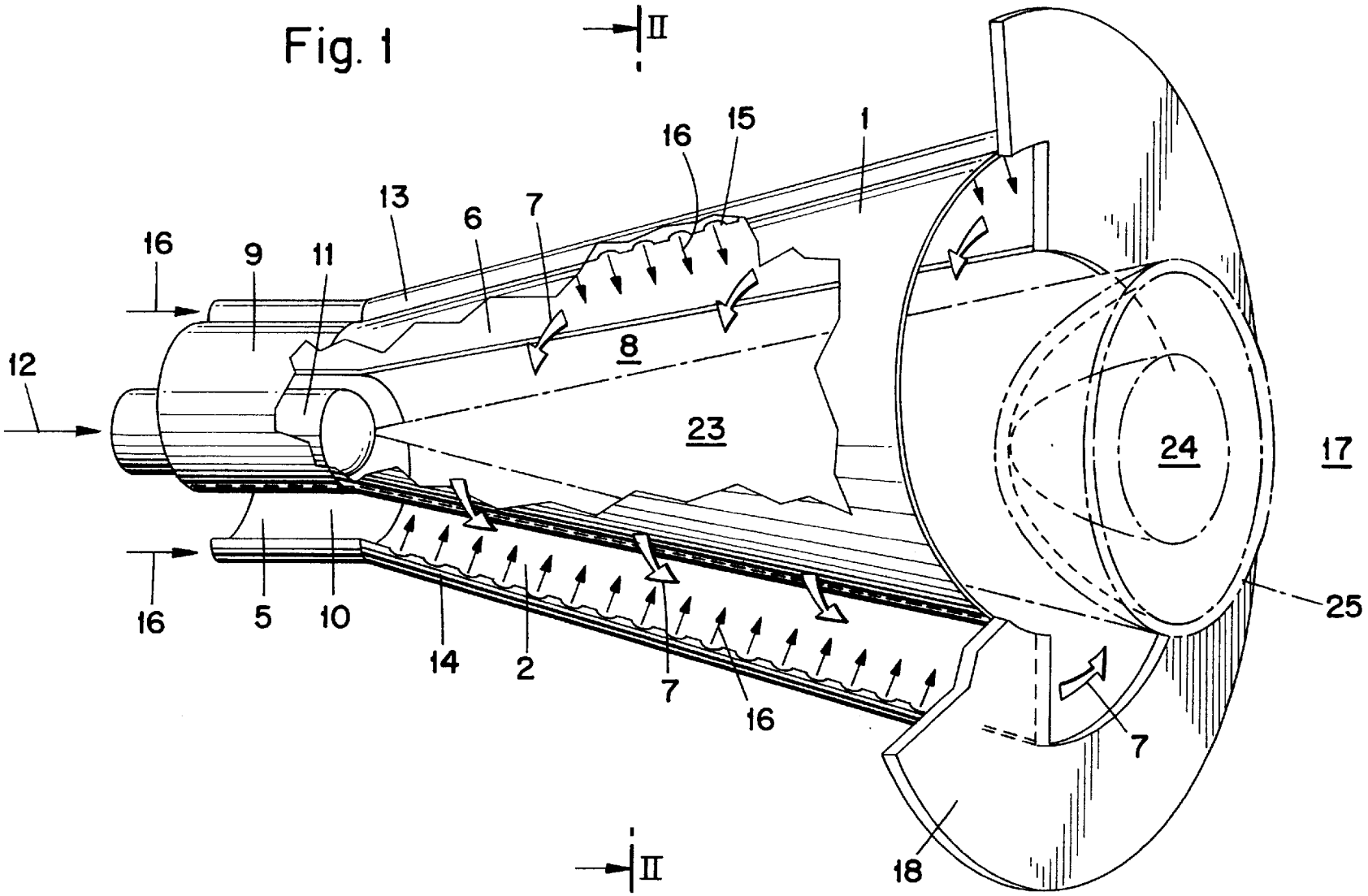
FIG. 1 shows a perspective illustration of the double cone burner.
Figure 2:
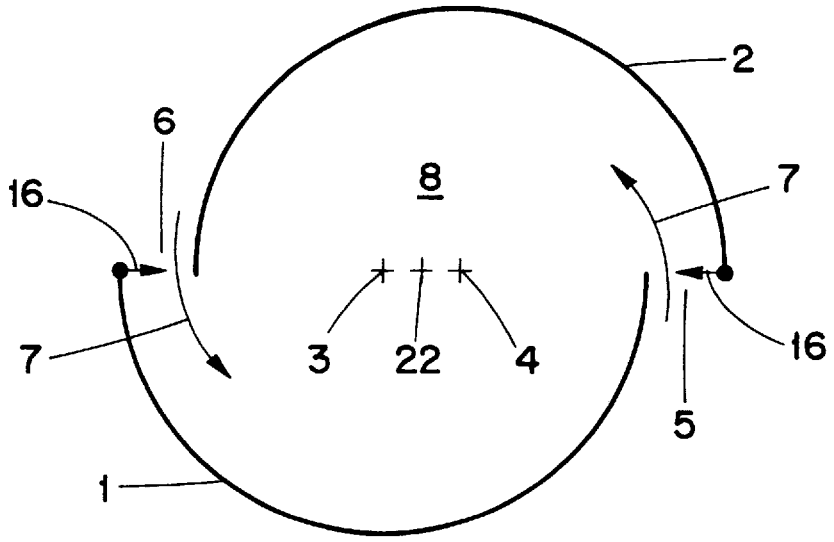
FIG. 2 shows a cross section of the burner according to FIG. 1 along the plane II—II.

Referring now to the drawings, wherein like reference numerals designate identical or corresponding parts throughout the several views, FIG. 1 shows a perspective illustration of a premixing burner of the double cone type. For better understanding, it is advantageous if the section in FIG. 2 is viewed simultaneously with FIG. 1.

The burner consists of two hollow part-cone bodies 1, 2 which lie one on the other so as to be offset relative to one another. The offset of the respective center axes 3, 4 of the part-cone bodies 1, 2 relative to one another and to the burner axis 22 produces a tangential air inlet slit 5, 6 in a mirror-inverted arrangement on each of the two sides, the combustion air 7 passing through said air inlet slits into the interior 8 of the burner. The two part-cone bodies 1, 2 each have a cylindrical initial part 9, 10, said initial parts likewise running so as to be offset relative to one another, so that the tangential air inlet slits 5, 6 are present in this region too. A nozzle 11 for atomizing the liquid fuel 12 is accommodated in this cylindrical initial part 9, 10. The burner may also be executed without the cylindrical initial parts 9, 10, so that it is of purely conical design. The fuel nozzle 11 is then accommodated directly in the cone apex. The two part-cone bodies 1, 2 each have a fuel line 13, 14, said fuel lines being provided with orifices 15 which constitute fuel injectors. By means of the fuel injectors 15, gaseous fuel 16 is admixed with the combustion air 7 flowing through the tangential air inlet slits 5, 6. On the combustion space side 17, the burner has a front plate 18 serving as an anchorage for the part-cone bodies 1, 2.

If liquid fuel 12 is used for operating the burner, this flows through the nozzle 11 and is injected at an acute angle into the burner interior 8, a homogeneous fuel spray being established. The conical liquid fuel profile 23 is surrounded by a rotating combustion air stream 7 flowing in tangentially. The concentration of the liquid fuel 12 is reduced continuously in the axial direction by means of the mixed-in combustion air 7. The optimum fuel concentration over the cross section is achieved only in the vortex shedding region, that is to say in the region of the inner recirculation zone 24. Ignition takes place at the tip of the inner recirculation zone 24. Only at this point does a stable flame front 25 occur. Flame stabilization is obtained by increasing the swirl coefficient in the direction of flow along the cone axis. A flashback of the flame into the interior of the burner does not occur under normal operating conditions.

If gaseous fuel 16 is burnt, the formation of a mixture with the combustion air 7 takes place in the air inlet slits 5, 6, that is to say before entry into the burner interior 8.

Burners of the double cone type are known to this extent. The occurrence of thermal stresses at the burner outlet is typical of these burners, because regions having different axial thermal expansion meet there, since the outer parts of the part-cone bodies 1, 2, firstly, are subjected to radiation to a less pronounced extent and, secondly, are cooled to a greater extent by the inflowing air 7 and the fuel gas 16 fed in the same region than the inner parts, which have a higher operating temperature.

According to the invention, then, it is proposed to arrange at least one relief slit 30 at the burner outlet between the regions having different axial expansion. In this case, the relief slit 30 may be arranged, for example, integrally within the front plate 18, which consists of a single part (see FIGS. 3 and 4), with the result that the outer regions of the front plate form the material bridge connecting the two parts, or said relief slit runs radially over a relatively short distance as far as the edge of the front plate and the material bridge connecting the two parts is formed by means of an additional part 31 welded to the front plate (see FIG. 5).

Figure 3:
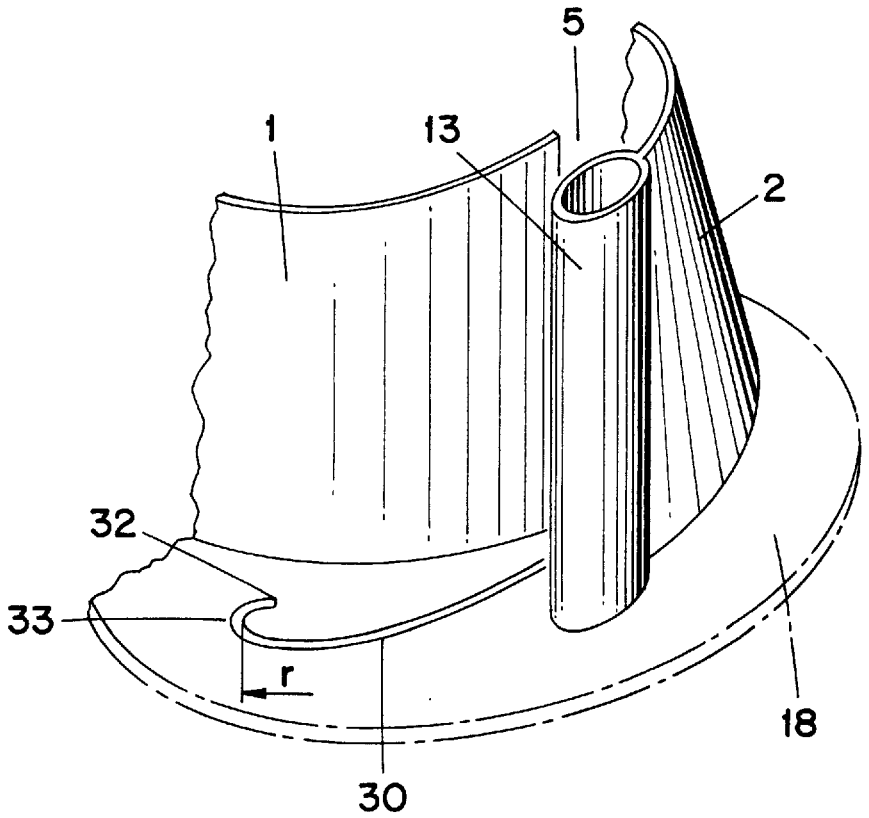
FIG. 3 shows a perspective illustration of the burner in the region of the burner outlet in a first design variant of the invention.
Figure 4:
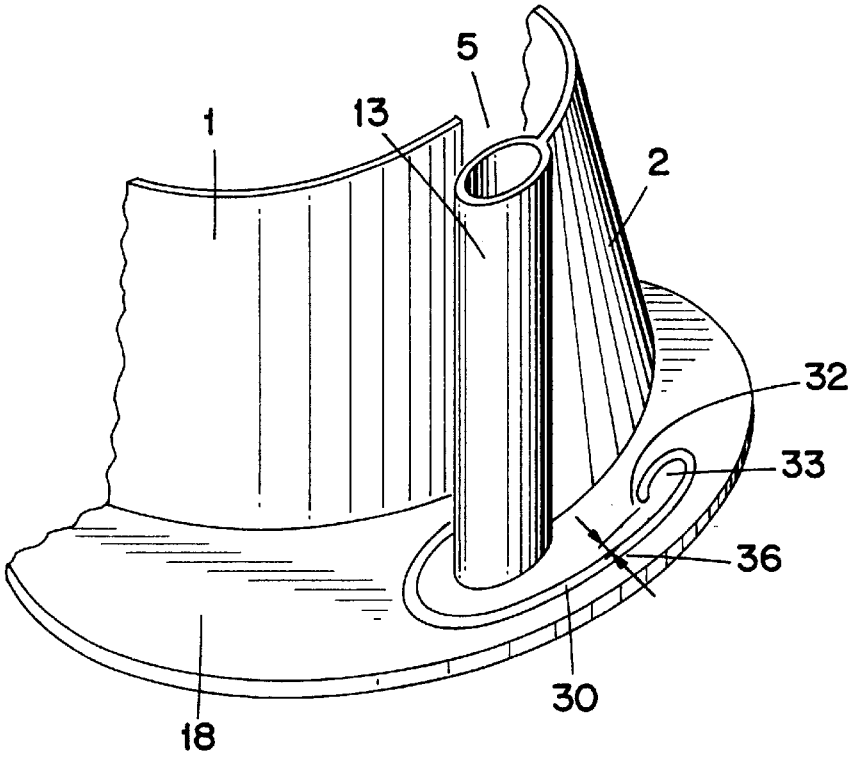
FIG. 4 shows a perspective illustration of the burner in the region of the burner outlet in a second design variant of the invention.

It may be gathered from the perspective illustration of part of the burner outlet region in FIG. 3 and FIG. 4 that the relief slit 30, introduced in a specific manner into the front plate 18, which consists of one part, commences in the region where the part-cone bodies 1, 2 meet and runs essentially parallel to the respective part-cone body 1, 2, and the termination (end piece) of said relief slit is curved in the direction of the part-cone bodies 1, 2.

In this case, the tip 32 of the relief slit 30 is deflected in its direction relative to the direction of the main extent of the relief slit 30 by at least approximately 180°, deflection taking place in a curvature 33 having generous dimensions in terms of notch and fracture mechanics, the greatest radius of curvature r being located at the point of maximum stress in the front plate 18, and the wall piece within the arc of curvature 33 being connected to the rest of the wall via a sufficiently dimensioned material cross section 36. In this case, the curvature 33 may have the form of a semi-circle to three-quarter circle (see FIG. 3), a semi-circle to three-quarter ellipse (see FIG. 4) or a semi-circle to three-quarter spiral or similar curve (not illustrated).

Figure 5:
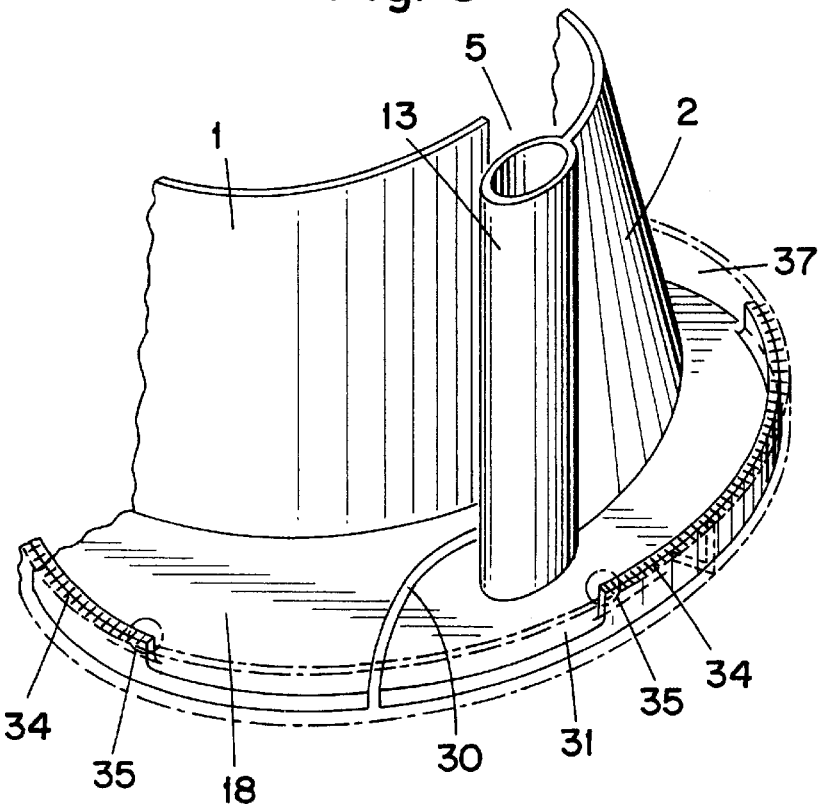
FIG. 5 shows a perspective illustration of the burner in the region of the burner outlet in a third design variant of the invention.

The design variant illustrated in FIG. 5 is different. The slit 30 likewise commences in the region where the part-cone bodies 1, 2 meet. Here, the relief slit 30 leads to the edge of the front plate in a slight arc along a relatively direct route, with the result that the part-cone bodies and, in each case, half of the front plate are cut free from one another. In this example, the connection between these parts is formed by a ring 31 which is slipped over from the front and which is welded to the partially present "collar" 37 of the front plate.

In this example, the termination of the slit is completely free of load, and therefore its form does not play any part here. By contrast, the ends of the weld seams 34 between the "collar" 37 of the front plate 18 and the slipped-over ring 31 would be prone to the growth of cracks in the event of excessive stresses, but this can easily be countered by an favorable design of the zones around the weld seam ends 35.

By virtue of the invention, the direct connection of the regions having different thermally induced axial expansion at the burner outlet is made more flexible. As a result, excessive thermal stresses are avoided and the premixing burner can therefore be used for a longer period of time.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A burner for the combustion of liquid (12) and gaseous (16) fuels, essentially consisting of at least two hollow part-cone bodies (1, 2) supplementing one another to form a body, with tangential air inlet slits (5, 6) and with feeds (13, 14) for gaseous (16) and liquid (12) fuels, in which burner the center axes (3, 4) of the hollow part-cone bodies (1, 2) have a taper widening in the direction of flow and run so as to be offset relative to one another in the longitudinal direction, a fuel nozzle (11) for the liquid fuel (12) being placed on the burner head in the conical interior (8) formed by the part-cone bodies (1, 2), and the feeds (13, 14) for the gaseous fuel (16) being provided with fuel injectors (15), and a front plate (18) being arranged, on the combustion space side, as an anchorage for the part-cone bodies (1, 2), said part-cone bodies (1, 2) having different thermal expansions in the direction of the burner axis (22) as a result of different thermal stress, and, in particular, the front plate (18) being subjected cyclically to stress at the burner outlet, wherein, for the purpose of an increase in flexibility, at least one relief slit (30) is arranged in the front plate (18) locally between the regions having different axial expansion, the relief slit (30) not separating the part-cone bodies (1, 2) completely from one another, but a material bridge still remaining between them.

2. The burner as claimed in claim 1, wherein the at least one relief slit (30) is arranged integrally within the front plate (18), which consists of a single part.

3. The burner as claimed in claim 1, wherein the at least one relief slit (30) cuts through the front plate completely, said relief slit (30) running to the edge of the front plate (18) in a slight arc, and the material bridge connecting the parts being formed by an additional part (31) welded to the front plate.

4. The burner as claimed in claim 2, wherein the at least one relief slit (30) in the front plate (18) commences in the region where the part-cone bodies (1, 2) meet and runs essentially parallel to the respective part-cone body (1, 2), and the termination of the relief slit is curved in the direction of the part-cone bodies (1, 2).

5. The burner as claimed in claim 4, wherein the tip (32) of the relief slit (30) is deflected in its direction relative to the direction of the main extent of the relief slit (30) by at least approximately 180°, deflection taking place in a curvature (33) having generous dimensions in terms of notch and fracture mechanics, the greatest radius of curvature (r) being located at the point of maximum stress in the front plate (18), and the wall piece within the arc of curvature (33) being connected to the rest of the wall via a sufficiently dimensioned material bridge (36).

6. The burner as claimed in claim 5, wherein the curvature (33) of the relief slit (30) has the form of a semi-circle to three-quarter circle.

7. The burner as claimed in claim 5, wherein the curvature (33) of the relief slit (30) has the form of a semi-ellipse to three-quarter ellipse or similar curves.

8. The burner as claimed in claim 5, wherein the curvature (33) of the relief slit (30) has the form of a spiral.

* * * * *